US009328887B2

(12) United States Patent
Hu

(10) Patent No.: US 9,328,887 B2
(45) Date of Patent: May 3, 2016

(54) ENHANCED ILLUMINATION EFFICACY OF WHITE COLOR FROM GREEN LASER AND MAGENTA PHOSPHOR

(71) Applicant: Darwin Hu, San Jose, CA (US)

(72) Inventor: Darwin Hu, San Jose, CA (US)

( * ) Notice: Subject to any disclaimer, the term of this patent is extended or adjusted under 35 U.S.C. 154(b) by 91 days.

(21) Appl. No.: 14/198,591

(22) Filed: Mar. 6, 2014

(65) Prior Publication Data

US 2015/0252974 A1 Sep. 10, 2015

(51) Int. Cl.
*F21S 8/10* (2006.01)
*F21Y 101/02* (2006.01)

(52) U.S. Cl.
CPC ..... *F21S 48/1225* (2013.01); *F21S 48/1145* (2013.01); *F21S 48/1731* (2013.01); *F21S 48/1757* (2013.01); *F21Y 2101/025* (2013.01)

(58) Field of Classification Search
CPC ..... F21S 48/1131; F21S 48/1225; F21S 48/1731; F21S 48/1757; F21S 48/1145; F21Y 2101/025
See application file for complete search history.

(56) References Cited

U.S. PATENT DOCUMENTS 5,299,101 A * 3/1994 Serizawa ..... F21S 48/1186 362/263
2001/0038535 A1* 11/2001 Furuya ..... B60Q 1/12 362/469
2011/0044579 A1* 2/2011 Travis ..... G02B 5/045 385/27
2012/0314398 A1* 12/2012 Raring ..... H01S 5/34333 362/84
2014/0003070 A1* 1/2014 Nakaya ..... B60Q 1/08 362/466
2015/0009695 A1* 1/2015 Christmas ..... B60Q 1/16 362/466

* cited by examiner

*Primary Examiner* — Bao Q Truong
(74) *Attorney, Agent, or Firm* — Joe Zheng

(57) ABSTRACT

Techniques related to generating daylight-like light from green laser and magenta phosphor are disclosed. Such light may be used in headlights of vehicles. The daylight-like light generated from green laser and filtered through magenta phosphor is almost white or substantially white. The white laser is generated from green laser that is filtered through magenta phosphor. The green laser is well known for producing the highest perceived intensity among all colored lasers with equal or similarly provided energy and is low to obtain in cost.

20 Claims, 9 Drawing Sheets

Calculation of Brightness of Laser Light in Red, Green and Blue

1. 12W RGB Laser Light Source:

- 532nm / G / 4.5w
- 635nm / R / 4w
- 473nm / B / 3.5w

2. RGB Light Spectral Luminous Efficiency:

*FIG. 2A*

2.1 Light Spectral Luminous Efficiency

Radiant Flux of light source（W）through Transfer Function of Light Spectra Luminous Efficiency as light Luminous Flux: $\Phi_{lm} = \Phi_W \times K_m \times V(\lambda)$ $K_m$ =683lm/W -- Maximum light spectral luminous efficiency, at $\lambda$ = 555nm $V(\lambda)$ – Spectral Luminous Efficiency Function，V(555)=1， others < 1.

2.2 Calculation of Laser Light Spectral Luminous Efficiency

532nm – $K_{532} = K_m \times V(532)$ =683 X 0.9 = 615 lm/w

635nm – $K_{635} = K_m \times V(635)$ =683 X 0.217 = 148 lm/w

473nm – $K_{473} = K_m \times V(473)$ =683 X 0.1 = 68.3 lm/w 2.3 Value of Spectral Luminous Efficiency Function: (refer to appendix table)

Where $y(\lambda) = V(\lambda)$

3. 12W RGB Luminous Flux of Laser Light Output is:

532nm : $\Phi_{532/lm} = \Phi_{532/W} \times K_{532} = 4.5 \times 615 = 2767.5$ lm 635nm : $\Phi_{635/lm} = \Phi_{635/W} \times K_{635} = 4 \times 148 = 592$ lm 473nm : $\Phi_{473/lm} = \Phi_{473/W} \times K_{473} = 3.5 \times 68.3 = 239$ lm Total Light Output of Luminous Flux = 3598.5 lm (=2767.5 + 592 + 239)

4. Light Utilization Efficiency Rate of LCOS Optical Engine is assuming about 20%, then the Luminous Flux of 12W RGB Laser Light Output seen from Screen is approximately 720 lumens. 3598.5 X 20% ≈ 720 lm

5. Since Laser's Electric Power to Light Conversion Efficiency is:

532nm – 15%

635nm – 22%

473nm – 15%

Then, 12W RGB laser Light Source Power Consumption Rate will be:

532nm - 4.5/0.15 = 30W

635nm - 4/0.22 = 18.2W

473nm - 3.5/0.15 = 23.3W

Total: 30+18.2+23.3= 71.5W

*FIG. 2B*

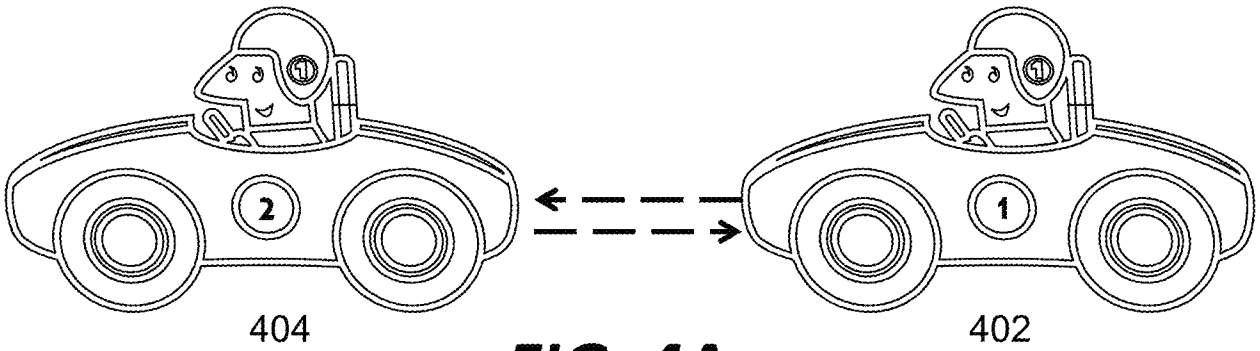
FIG. 4A
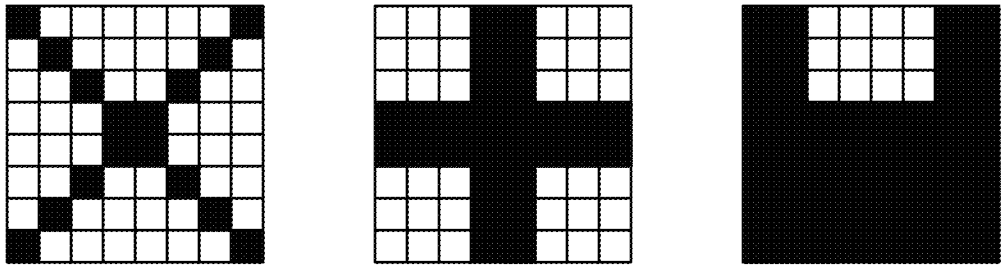
FIG. 4B
FIG. 4C
FIG. 4D

ENHANCED ILLUMINATION EFFICACY OF WHITE COLOR FROM GREEN LASER AND MAGENTA PHOSPHOR

BACKGROUND OF THE INVENTION

1. Field of the Invention

The present invention is generally related to the area of lights and more particularly relates to techniques for generating daylight-like light from green laser and magenta phosphor. Such light is used in headlights of automobiles in one embodiment.

2. Description of the Related Art

Laser is produced from a device that emits light through a process of optical amplification based on the stimulated emission of electromagnetic radiation. The term "laser" originated as an acronym for "light amplification by stimulated emission of radiation". Lasers differ from other sources of light because they emit light coherently. Spatial coherence allows a laser to be focused to a spot, enabling applications like laser cutting and lithography. Spatial coherence also allows a laser beam to stay narrow over long distances (collimation), enabling applications such as laser pointers. Lasers can also have high temporal coherence which allows them to have a very narrow spectrum, namely, they only emit a single color of light.

Lasers have many important applications. They are used in common consumer devices such as DVD players, laser printers, and barcode scanners. They are used in medicine for laser surgery and various skin treatments, and in industry for cutting and welding materials. They are also used in military and law enforcement devices for marking targets and measuring range and speed.

Recently BMW and Audi feature laser headlights in their certain models. The laser headlights are said to be 30 percent more energy efficient than the basic LED headlights, and to reduce bulk and weight by replacing the standard LEDs with laser diodes that are 10 times smaller. Further, it reports that the light of a laser headlamp is extremely bright, similar to daylight, which is perceived by the human eye as pleasant.

Similar to the daylight, the light of a laser headlamp shall be in white or substantially white color. To produce white color laser, one or more blue lasers are used and focused into a lens filled with yellow phosphorus. The yellow phosphorus, when excited by the blue laser, emits an intense white light. As further described below, blue lasers are not efficient. In fact, the blue laser is the lowest in light intensity when perceived by the human eyes.

Accordingly, there is a need for even more efficient laser that can be used to generate white laser. Such white laser may be used in laser headlights for vehicles, laser video or movie projection and other illumination applications.

Lasers differ from other sources of light because they emit light coherently. Spatial coherence allows a laser to stay narrow over long distances (collimation). When two vehicles are on road, there is a need for brief communication between the two vehicles. The laser-base light makes the communication between two vehicles possible by projecting a predefined light pattern from one vehicle to another. The received light pattern delivers a specific message according to a predefined protocol or based on a common understanding.

The predefined light pattern is formed by a light controller operating on a LCD or LCoS unit that can be programmed or electronically controlled in accordance with a command from a driver or a camera monitoring a surrounding of a vehicle.

There is a further need to prevent from projecting light onto a rear view window of a vehicle ahead to cause reflection from the rear-view mirror so as to interfere with the driver of the vehicle.

SUMMARY OF THE INVENTION

This section is for the purpose of summarizing some aspects of the present invention and to briefly introduce some preferred embodiments. Simplifications or omissions in this section as well as in the abstract and the title may be made to avoid obscuring the purpose of this section, the abstract and the title. Such simplifications or omissions are not intended to limit the scope of the present invention.

The present invention is generally related to techniques for generating daylight-like light from green laser and magenta phosphor. Such light may be used in headlights of automobiles. According to one aspect of the present invention, the daylight-like light generated from green laser and filtered through magenta phosphor is almost white or substantially white (a.k.a.: white laser hereinafter). The white laser is generated from green laser that is filtered through magenta phosphor. The green laser is well known for producing the highest perceived intensity among all colored lasers with equal or similar provided energy.

According to one embodiment, the green laser is coupled to the magenta phosphor that turns the green laser into the white laser. Through a diffuser, the white laser is converted to white light beams. With a spatial light modulator employed, the white light beams are controlled in accordance with the ambient condition to be fully released out (i.e., same intensity), dimmed or turned around.

The present invention may be implemented as an apparatus or a part of system. According to one embodiment, the present invention is a light source, the light source comprises a laser source to generate green laser; magenta phosphor provided to filter the green laser to generate white laser, wherein the magenta phosphor is produced by mixing two different types of phosphor; and an optical diffuser to diffuse the white laser to produce white light beams. The light source further comprises a light controller electronically controlling how to transmit the white light beams therethrough in accordance with a road condition.

One of the features, benefits and advantages in the present invention is to provide enhanced Illumination efficacy of white color from green laser and magenta phosphor.

Another one of the features, benefits and advantages in the present invention is to provide a predefined light pattern for optimum illumination for a vehicle.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

FIG. 2A and FIG. 2B show the detailed calculation of brightness of the laser lights in red (R), green (G) and blue (B);

FIG. 4A shows that two vehicles communicate with each other using a light implemented in accordance with the embodiment shown in FIG. 3A; and FIG. 4B, FIG. 4C and FIG. 4D each show that an exemplary pattern that may be formed by programming electronically to manipulate liquid crystals in a light controller.

DETAILED DESCRIPTION OF THE PREFERRED EMBODIMENTS

The detailed description of the invention is presented largely in terms of procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Figure 1:
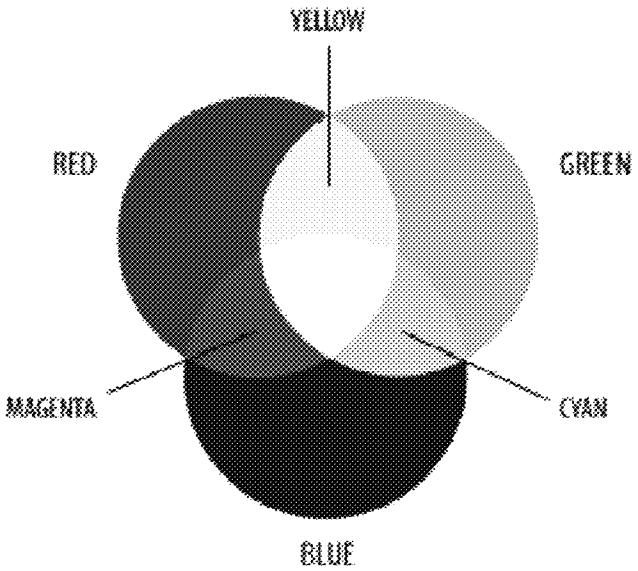
FIG. 1 shows a well-known additive color wheel that is a practical guidance to color mixing and the visual effects of a specific color combination.

Referring now to the drawings, in which like numerals refer to like parts throughout the several views, FIG. 1 shows a well-known additive color wheel 100 that is a practical guidance to color mixing and the visual effects of a specific color combination. There are also definitions (or categories) of colors based on the color wheel: primary color, secondary color and tertiary color. Color theory was originally formulated in terms of three primary or primitive colors: red, Green and blue (RGB), because these colors were believed capable of mixing all other colors while the secondary color includes yellow, magenta and cyan (YMC). It can be perceived that the combination of blue and yellow produces white color, and the combination of green and magenta also produces white.

A phosphor, most generally, is a substance that exhibits the phenomenon of luminescence. Somewhat confusingly, this includes both phosphorescent materials, which show a slow decay in brightness (>1 ms), and fluorescent materials, where the emission decay takes place over tens of nanoseconds. Phosphorescent materials are known for their use in radar screens and glow-in-the-dark toys, whereas fluorescent materials are common in cathode ray tube (CRT) and plasma video display screens, sensors, and white LEDs.

Currently, the lasers are commercially available in the primary colors. The prior art approach is to transmit the blue laser through yellow phosphor to produce the white laser. As mentioned above, the blue laser is the lowest in light intensity when perceived by the human eyes. Blue laser is a laser beam that emits electromagnetic radiation at a wavelength of between 360 and 480 nanometers, which the human eye sees as blue or violet. The blue laser is relatively new to green or red laser. It is commonly known that the perceived light intensity of the blue laser is much weaker than that of the green laser. In practice, the cost of generating blue laser is more expensive than that for the green laser.

FIG. 2A and FIG. 2B show the detailed calculation of brightness of the laser lights in red (R), green (G) and blue (B). The calculation or proof is evident to those skilled in the art that the green laser is far brighter than the blue laser. Typically operating at 532-550 nanometers, under 5 mW, these lasers can be visible for thousands of feet in normal conditions, which makes them completely viable for shining into the starry sky and more than capable of handling classroom pointing duties.

Figure 3A:
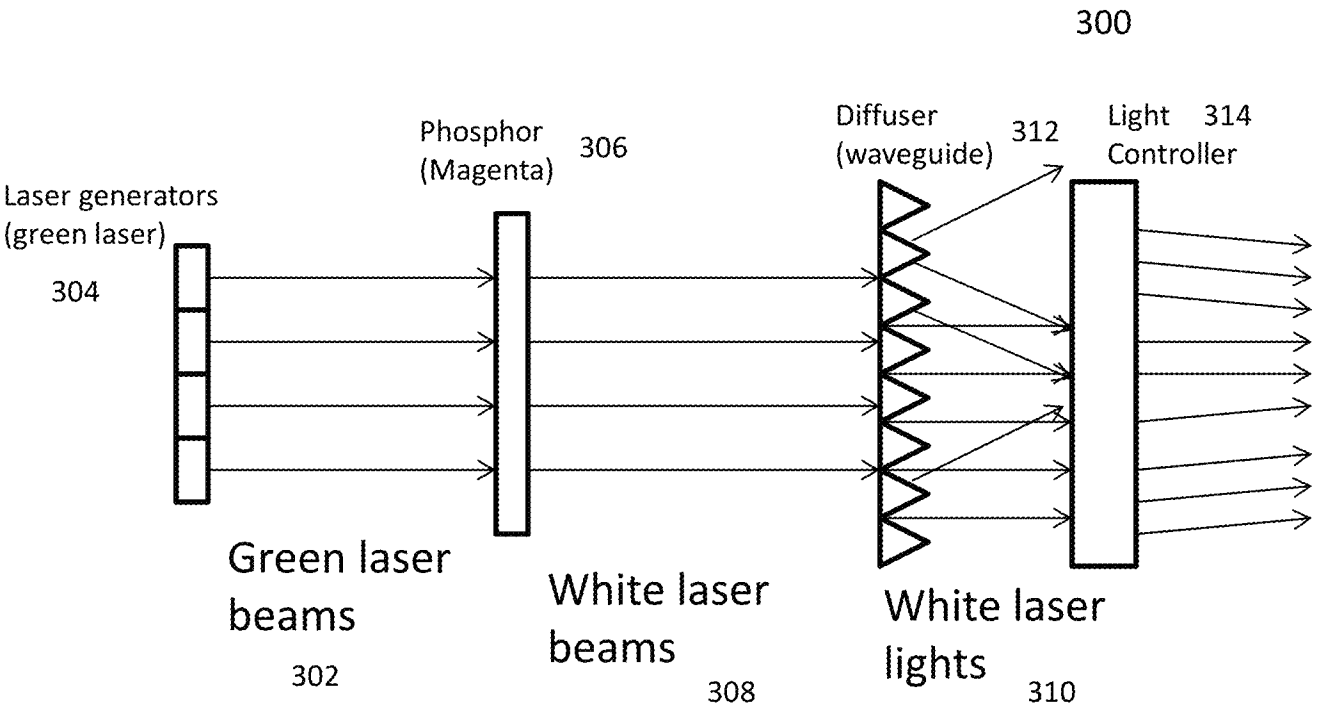
FIG. 3A shows one configuration of using green laser and magenta phosphor to produce diffused white light beams.

According to one embodiment of the present invention, FIG. 3A shows one configuration of using green laser and magenta phosphor to produce diffused white light beams. The green laser beams 302 are produced by one or more laser diodes or green laser sources 304. In one embodiment, an array of green laser diodes 532 nm DPSS Laser Diodes from Thorlabs, Inc. located at 56 Sparta Ave, Newton, N.J. 07860, are used. The green laser beams 302 are coupled to a filter or a coating 306 made of phosphor in magenta. Magenta is a purplish red color and one of the three primary colors of the subtractive CMYK color model. As shown in FIG. 1, magenta is located midway between red and blue. Depending on implementation, there are some ways to obtain magenta phosphor. In one embodiment, the magenta phosphor is produced by mixing blue phosphor with reddish orange or red phosphor. By mixing the blue phosphor and the red phosphor in a predefined ratio (e.g., 20:80 or 50:50), the resulting phosphor emits a pink color in a CIE chromaticity diagram. The wavelength spectrum of the resulting phosphor actually shows two peaks of a blue and a red wavelength, but a user cannot differentiate the separate colors but rather sees only the mixed pink color.

In one embodiment, the pink or magenta phosphor may further include metal additives to increase its luminous efficiency, brightness and color maintenance. The preferable metal additive includes Zn, where Zn is added to the phosphor in the form of minuscule particles having diameters of 0.1 to 100 micrometers. Preferably, a Zn particle has a diameter of 0.1-10 μm and at least 95% purity. Further details of producing the pink phosphor may be found in U.S. Pat. No. 6,200,497, entitled "low-voltage excited pink phosphor" which is hereby incorporated by reference. In another embodiment, the magenta phosphor is replaced by some thin film filters (TFF) with predefined wavelengths that are combined to achieve what the magenta phosphor is expected to do.

According to the additive color wheel 100 of FIG. 1, the mixture of green light and magenta phosphor produces white laser beams 308. To convert the point-like laser beams 308 to white light 310, a diffuser or waveguide 312 is provided to diffuse, spread or scatter the white laser beams to eventually produce illumination comparable to white light or daylight. In one embodiment, the diffuser 312 is coated with the magenta phosphor to produce the white light 310.

The white light 310 is then coupled to what is called herein a light controller 314. As will be described further below, instead of installing a moving mechanism to move the light beams in adaptive headlights, the light controller 314 uses a spatial light modulator (SLM) to cause the light beams to turn in accordance how the vehicle is moving along a curved road. Standard headlights always shine straight ahead, no matter what direction the car is moving. When going around curves, the headlights illuminate the side of the road more than the road itself. Adaptive headlights react to the steering, speed and elevation of the car and automatically adjust to illuminate the road ahead. When the car turns right, the headlights angle to the right. When the car turns left, the headlights angle to the left. The light controller 314 can also be used in self-leveling headlights. In one embodiment, the configuration of FIG. 3A can be used in adaptive brake lights to show how hard the driver is applying the brakes.

Figure 3B:
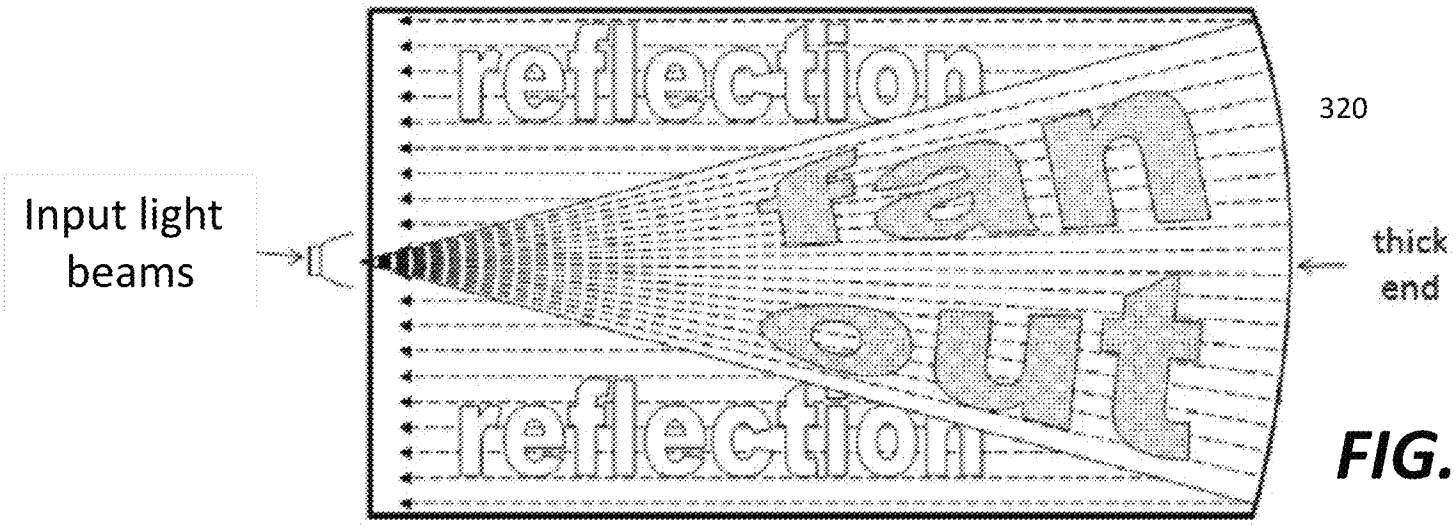
FIG. 3B shows an exemplary waveguide that may be used in FIG. 3A as the diffuser or waveguide 312.
Figure 3C:
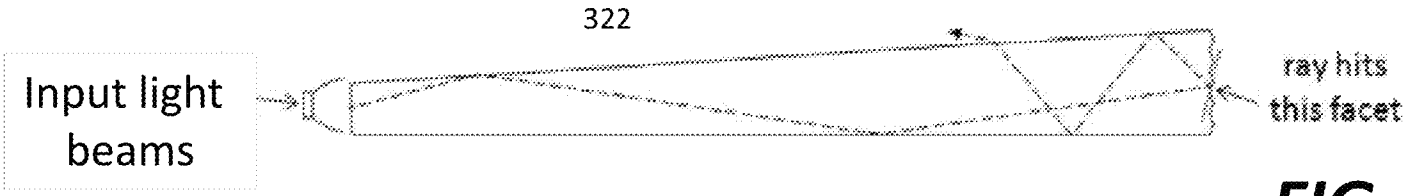
FIG. 3C shows a corresponding side view of the waveguide in FIG. 3B.

FIG. 3B shows an exemplary waveguide 320 that may be used in FIG. 3A as the diffuser or waveguide 312. FIG. 3C shows a corresponding side view 322 of the waveguide 320. By using the gradually raised surface, an incoming light beam can be fanned out. Although other forms of the waveguide 320 may be used, the purpose of the waveguide or diffuser 320 diffuse, spread or scatter the white laser beams to eventually produce from the white laser to illumination (white light beams) comparable to white light or daylight. In one embodiment, the magenta phosphor is coated right onto the diffuser 320. In another embodiment, the magenta phosphor is mixed in the material that is used to make an epoxy lens or the diffuser 320.

Figure 3E:
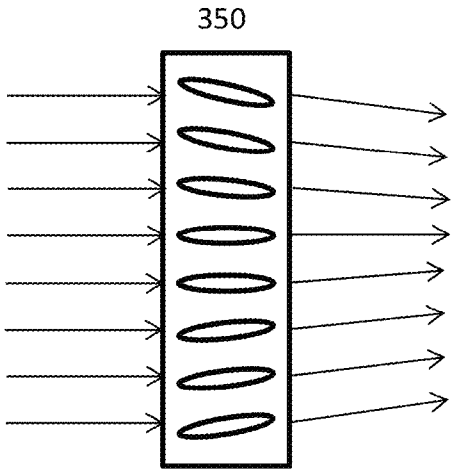
FIG. 3E shows an example of focal illumination towards an optical axis of a headlight or a point on a road.
Figure 3D:
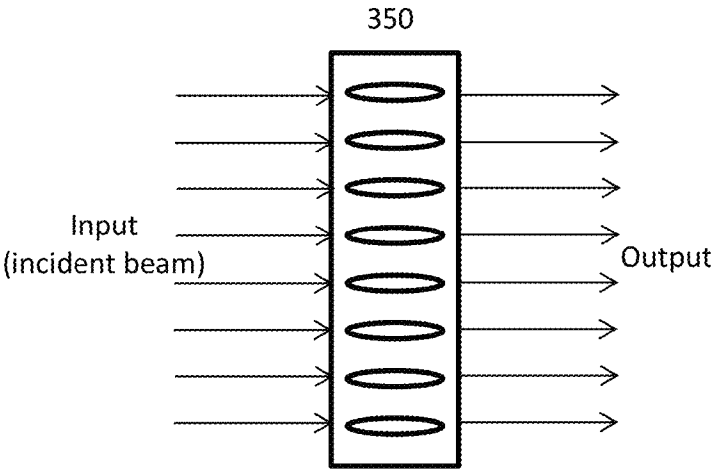
FIG. 3D shows an example of the light controller of FIG. 3A.

FIG. 3D shows an example of the light controller 314 of FIG. 3A. According to one embodiment, the light controller 314 is implemented with one or more spatial light modulators (SLMs). An SLM is a device used to modulate amplitude, phase or polarization of a light wave in space and time. Current SLMs are either using microelectromechanical systems (MEMS) technology like Texas Instrument DLP (Digital Light Processing) technology or LCD (liquid crystal display) technology including transmissive LCD panel like Epson's HTPS (High Temperature Poly Silicon) type or reflective liquid crystal on silicon (LCoS) technology. Most of them manipulate the intensity or amplitude of light for projection display.

Liquid crystals are outstanding materials for SLMs because of their inherent property of very large birefringence and their facility to control the alignment of the molecules using an electric field. The electrically controllable liquid crystal birefringence enables the possibility to modulate not only amplitude but also phase and/or polarization of the incident beam. The SLMs based on LC materials consist of an array of pixels that contains a LC layer sandwiched between two flat electrodes to control its alignment by a potential difference. The plates are transparent (glass plus a transparent conductive layer) or reflecting (silicon) and initial alignment of the nematic molecules are set due to a thin polished polymer layer. The operational details of the SLM are not to be described herein further to avoid obscuring the relevant aspects of the present invention.

Not explicitly shown in FIG. 3D, the light controller 350 is electronically controlled automatically or manually in accordance with the driving ambient light or road conditions. In operation, the liquid crystals may be perceived as individual conduits to transmit the incident beam through depending on how these liquid crystals are controlled. For direct illumination, the liquid crystals are fully turned on to allow the incident light to transmit through. For dimmed illumination, the liquid crystals are partially turned on to allow some of the incident light to transmit through. For focal illumination as shown in FIG. 3E, the liquid crystals are turned towards an optical axis of a headlight or a point on a road so that the incident light beams are focused along the optical axis to the point on the road ahead. For adaptive illumination as shown in FIG. 3F, the liquid crystals are turned in a way to cause the incident light beams to shine the road itself in accordance how the vehicle is moving along a curved road.

Figure 3F:
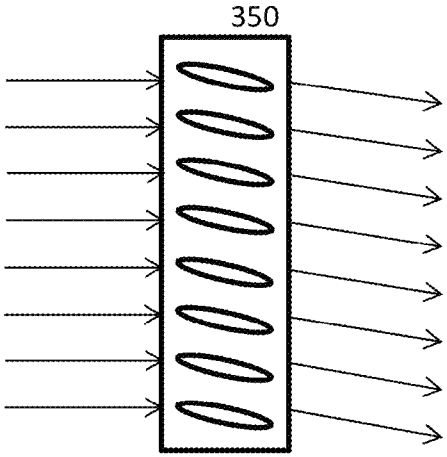
FIG. 3F shows how the liquid crystals are turned in a way to cause the incident light beams to shine the road itself when the vehicle is moving along a curved road.
Figure 3G:
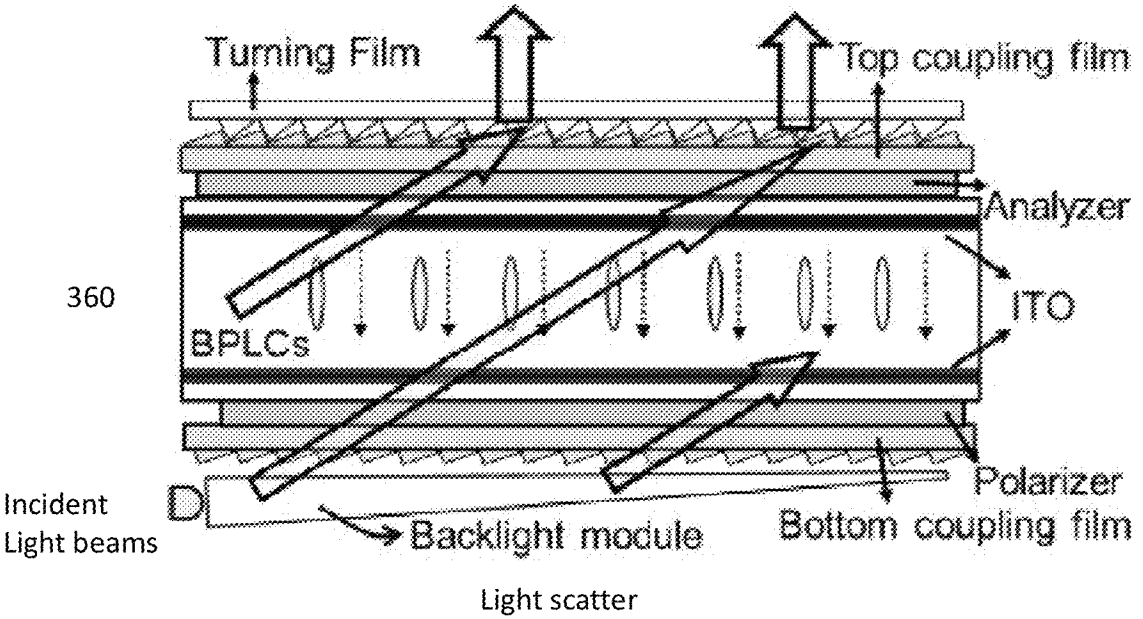
FIG. 3G shows an example of using a transmissive LCD unit to control an incident laser light beam.
Figure 3H:
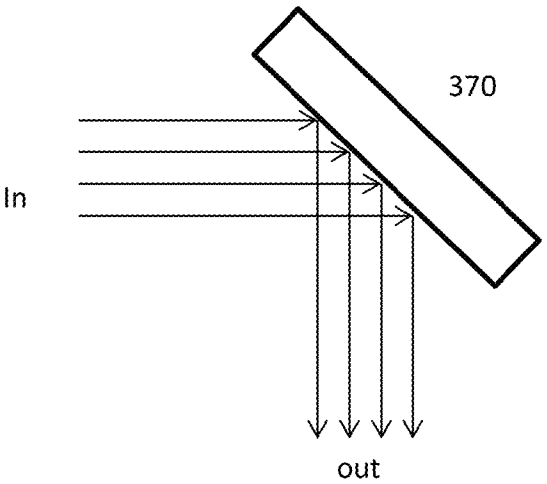
FIG. 3H shows an example of using a reflective LCoS in a light controller.

Without any implied limitations, the light controller 350 in FIG. 3D-3F may be viewed as a transmissive light controller that may be implemented using a LCD unit 360 in one embodiment, as shown in FIG. 3G. The operation details of the LCD unit 360 may be found in Hui-Chuan Cheng, et al. "Blue-phase liquid crystal displays with vertical field switching", pages 98-103, Journal of Display Technology, Vol. 8, No.: 2, February 2012, which is hereby incorporated by reference. According to another embodiment, the light controller 350 in FIG. 3D-3F may be a reflective light controller 370 that can be implemented using a liquid crystal on silicon (LCoS). An LCoS unit is a "micro-display" technology developed initially for projection display but now used also in Wavelength Selective Switches, structured illumination and Near-eye displays. It is a reflective technology similar to DLP projectors, however, it uses a liquid crystal layer on top of a silicon backplane instead of individual mirrors. FIG. 3H shows an example of using an LCoS in a light controller.

In practice, a headlight must be shining below the rear window when a vehicle is close behind another vehicle. It is a challenge for mechanical-based headlights to switch the beam when a vehicle. With the light controller implemented with a SLM controlled electronically, a pattern can be programmed to avoid shining the rear window of the vehicle ahead, or cause the projected light not to interfere the driver in front when the driver looks through from reflection mirror or rear window.

Referring now to FIG. 4A, it shows that two vehicles 402 and 404 communicate with each other using a light implemented in accordance with the embodiment shown in FIG. 3A. Lasers differ from other sources of light because they emit light coherently. Spatial coherence allows a laser to stay narrow over long distances (collimation), which makes the communication over the laser possible.

In the context of the present invention, as shown in FIG. 4A, an incident light is projected through a light controller (e.g., the light controller 314 of FIG. 3A or the light controller 350 of FIG. 3D-3F) from the vehicle 402. The vehicle 404 ahead of the vehicle 402 is equipped with a laser sensor that may be installed at the rear end of the vehicle 404 (not shown in FIG. 4A) to receive the transmitted light from the light controller of the vehicle 402. It should be noted that a transmitted light may also be from the rear end of the vehicle 404 and be intercepted by a laser diode installed at the front end of the vehicle 402.

As described above, the light controller 314 is able to control how the incident light transmits therethough. According to one embodiment, the layer of crystals in the light controller 314 is controlled to allow a pattern of light to pass through. FIG. 4B shows an example of a cross-sign. To facilitate the showing of a designated pattern, the blackened squares in FIG. 4B, FIG. 4C and FIG. 4D indicate that the corresponding liquid crystals are partially or fully opened to allow an incident light to pass through while the white or unblackened squares are set to block the incident light. Because of the spatial coherence in the laser light, the light coming out of the light controller 314 stays in the pattern and then intercepted by a laser sensor or camera (or an array of laser diodes disposed behind a lens). The pattern is picked up by the vehicle with the laser sensor or camera. When a set of protocols are established for vehicle communication based on laser light, such a pattern may be interpreted as a message (e.g., the vehicle 404 indicates to the vehicle 402: please do not tailgate, I am about to stop, or the vehicle 402 indicates to the vehicle 404: do not go too fast, I cannot follow you). FIG. 4C shows another example of projecting a cross-sign light pattern as a vehicle message for another vehicle to intercept.

Figure 3I:
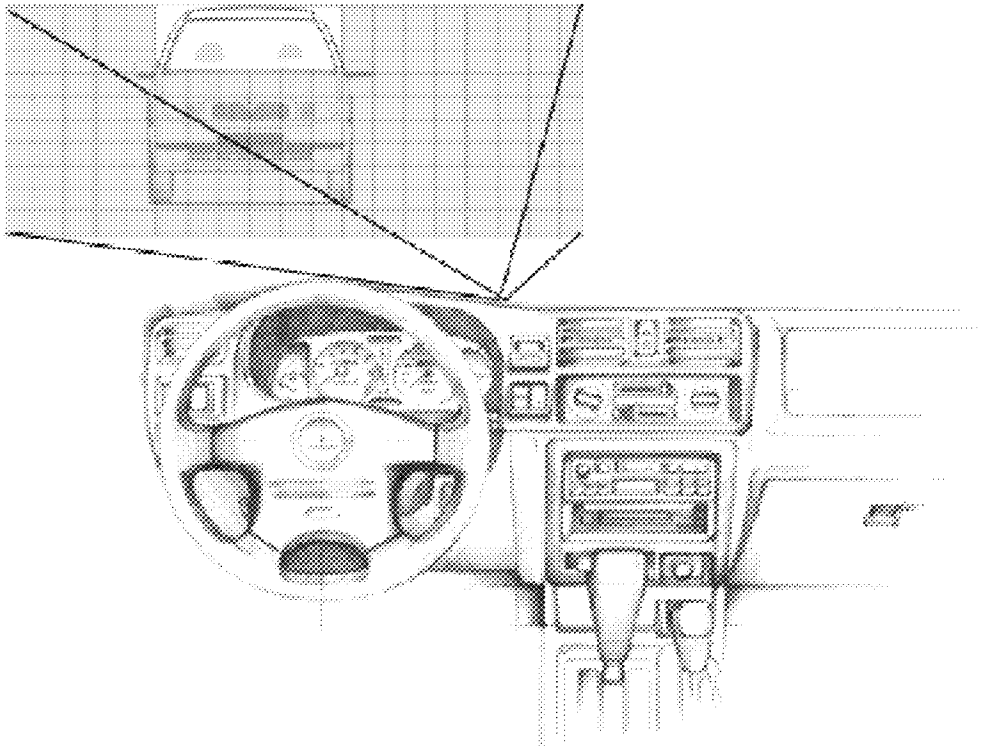
FIG. 3I shows an example of controlled lighting to avoid interfering with a driver in a vehicle ahead.

FIG. 4D shows a specific pattern that may be used in the case of FIG. 3I. The pattern has a predesigned or electronically configured window 406 that fully blocks the light. As a result, a unique light pattern is projected from a headlight contemplated in one embodiment of the present invention. The unshined light window avoids projecting light onto a rear window so as to cause reflection from the rearview mirror onto the vision of the driver.

The present invention has been described in sufficient detail with a Phosphorus certain degree of particularity. It is understood to those skilled in the art that the present disclosure of embodiments has been made by way of examples only and that numerous changes in the arrangement and combination of parts may be resorted without departing from the spirit and scope of the invention as claimed. For example, the white light generated herein may be used as backlighting in LCD units for display purpose. Many LCD units use white LEDs for their backlighting. The lased-based white light shall replace the LEDs and provide efficient backlighting in the LCD units. Accordingly, the scope of the present invention is defined by the appended claims rather than the forgoing description of embodiments.

I claim:

1. An apparatus comprising:

a laser source to generate a green laser light;

magenta phosphor provided to filter the green laser light to generate a white laser light, wherein the magenta phosphor is produced by mixing two different types of phosphor in a predefined ratio; and an optical diffuser to diffuse the white laser light to produce white light beams.

2. The apparatus as recited in claim 1, further comprising a light controller electronically controlling how to transmit the white light beams therethrough in accordance with a road condition.

3. The apparatus as recited in claim 2, wherein the apparatus is part of a headlight in a vehicle.

4. The apparatus as recited in claim 3, wherein the light controller allows the white light beams to fully pass therethrough to shine a road ahead.

5. The apparatus as recited in claim 3, wherein the light controller causes the white light beams to focus onto a point along a road ahead.

6. The apparatus as recited in claim 3, wherein the light controller causes the white light beams to turn in a way to shine a road itself when the vehicle is moving along a curved road.

7. The apparatus as recited in claim 2, wherein the light controller is implemented with a spatial light modulator (SLM).

8. The apparatus as recited in claim 7, wherein the spatial light modulator (SLM) is based on liquid crystals.

9. The apparatus as recited in claim 1, wherein the magenta phosphor is produced by mixing blue phosphor with reddish orange or red phosphor, and the optical diffuser is coated with a mixture of the blue phosphor with the reddish orange or the red phosphor.

10. The apparatus as recited in claim 9, wherein the magenta phosphor further includes metal additives to increase luminous efficiency, brightness and color maintenance thereof.

11. A method comprising:

generating a green laser light;

filtering the green laser light through magenta phosphor provided to generate a white laser light, wherein the magenta phosphor is produced by mixing two different types of phosphor in a predefined ratio; and diffusing the white laser light through an optical diffuser to produce white light beams.

12. The method as recited in claim 11, further comprising transmitting the white light beams through a light controller in accordance with a road condition.

13. The method as recited in claim 12, wherein the method is implemented in a headlight in a vehicle.

14. The method as recited in claim 13, wherein the light controller allows the white light beams to fully pass therethrough to shine a road ahead.

15. The method as recited in claim 13, wherein the light controller causes the white light beams to focus onto a point along a road ahead.

16. The method as recited in claim 13, wherein the light controller causes the white light beams to turn in a way to shine a road itself when the vehicle is moving along a curved road.

17. The method as recited in claim 12, wherein the light controller is implemented with a spatial light modulator (SLM).

18. The method as recited in claim 17, wherein the spatial light modulator (SLM) is based on liquid crystals.

19. The method as recited in claim 11, wherein the magenta phosphor is produced by mixing blue phosphor with reddish orange or red phosphor, and the optical diffuser is coated with a mixture of the blue phosphor with the reddish orange or the red phosphor.

20. The method as recited in claim 19, wherein the magenta phosphor further includes metal additives to increase luminous efficiency, brightness and color maintenance thereof.

* * * * *